United States Patent [19]

Fink

[11] Patent Number: 4,841,596

[45] Date of Patent: Jun. 27, 1989

[54] HANDLE WITH SHAPED RECESSES TO SUPPORT FLIMSY BAG STRAPS

[75] Inventor: Michael P. Fink, Los Angeles, Calif.

[73] Assignees: Nellie M. Fink; Martha M. Fink, both of West Los Angeles; Susan M. Edwards, Hollywood, all of Calif.

[21] Appl. No.: 201,884

[22] Filed: Jun. 3, 1988

[51] Int. Cl.[4] ..... B25G 1/10

[52] U.S. Cl. ..... 16/114 B; 16/DIG. 12; 383/13

[58] Field of Search ..... 16/110 R, 111 R, 114 R, 16/114 B, 116 R, DIG. 12; 383/13, 15, 26, 30; 224/271

[56] References Cited

U.S. PATENT DOCUMENTS

| | | | |
|---|---|---|---|
| 1,538,022 | 5/1925 | Brekke . | |
| 1,675,439 | 4/1928 | Wolf . | |
| 1,742,867 | 1/1930 | Levi . | |
| 2,684,797 | 7/1954 | Schulte . | |
| 2,846,714 | 8/1958 | Charlick | 16/114 B |
| 2,852,114 | 9/1958 | Heit . | |
| 3,102,446 | 9/1963 | Raleigh | 224/271 X |
| 3,207,397 | 9/1965 | Wilson . | |
| 3,306,507 | 2/1967 | Wilson . | |
| 3,321,798 | 5/1967 | Plamondon | 16/114 R |
| 3,486,684 | 12/1969 | Dills et al. | 16/114 B X |
| 3,800,361 | 4/1974 | Stauffer . | |
| 3,913,172 | 10/1975 | Richards, deceased et al. . | |
| 4,091,497 | 5/1978 | Blade | 16/110 R |
| 4,112,542 | 9/1978 | Snyder . | |
| 4,590,640 | 5/1986 | Enersen . | |

*Primary Examiner*—Fred A. Silverberg

*Attorney, Agent, or Firm*—William W. Haefliger

[57] ABSTRACT

An easily molded plastic handle is usable to quickly, firmly and reliably support and retain the narrow flimsy plastic handle strands of one or more plastic bags, and to close such bags.

8 Claims, 2 Drawing Sheets

HANDLE WITH SHAPED RECESSES TO SUPPORT FLIMSY BAG STRAPS

BACKGROUND OF THE INVENTION

This invention relates generally to devices for supporting bags, and more particularly concerns an easily molded, improved handle usable to quickly, firmly, and reliably support and retain the narrow plastic handle strands of one or more flimsy plastic bags, and simultaneously.

It is known that flimsy plastic bags, as for example are currently used by many grocery stores and other retail outlets, afford the user a convenient means of transporting small and medium sized objects; however, such bags can, at times, and depending on the number of bags and the weight of each, become difficult and uncomfortable to carry, simultaneously. Also, such bags tend to spill their contents when resting on vibrating surfaces, such as vehicle floors. There is need for means co-operable with the narrow flimsy plastic handle straps of such flimsy bags, in such manner as to obviate the above problems, and also to carry filmsy bag straps in a secure manner.

SUMMARY OF THE INVENTION

It is a major object of the invention to provide a unitary, durable, molded plastic handle constructed to meet the above need.

It is another object to provide such a unitary handle capable of supporting and carrying the flimsy plastic straps of one or more plastic bags, and at spaced locations, the handle also having a ribbed construction between such spaced locations, and which may be surface textured, to provide a comfortable, secure grip for the user's hand.

It is a further object to provide bag strap retention means on a handle and characterized in that once the straps are inserted into retention gaps, they are effectively locked in place against accidental removal, and until such time as they are deliberately removed, normally.

It is yet another object to provide a handle as referred to which secures the tops of flimsy bags in semi-closed position or positions, reducing the chance of damage to articles in the bag or bags and preventing spillage of the articles from the bag or bags.

Another object is the provision of a handle configuration that allows bags to be transported with the two straps of each bag located respectively forwardly and rearwardly relative to the user's walk direction, whereby the bag or bags may be carried with their larger width dimensions parallel to the user's body.

Basically, the improved handle comprises:

(a) a handle body which is horizontally, longitudinally elongated and has opposite ends, front and rear sides, and top and bottom surfaces, the body having opposite end portions and an intermediate portion between said end portions, (b) there being recesses extending downwardly at said end portions from said top surfaces and terminating within said end portions, said recesses intersecting said front and rear sides, (c) the handle body defining local protuberances extending in the length direction of said handle and into the recesses, the widths of the recesses being narrowed by said protuberances to form gaps spaced above the lowermost extents of the recesses.

Typically, there are two pairs of such protuberances, the protuberances of a first pair extending longitudinally oppositely and into one recess, and the protuberances of the second pair extending longitudinally oppositely and into the other recess, a gap being formed between the protuberances of each pair. Also, each recess typically has opposite vertical walls from which the two protuberances project toward one another, the protuberances having undersides normal to such walls; and, one of each such walls of a recess having a vertical dimension substantially greater than the vertical dimension of the other wall, said one vertical wall located closer to the end of the handle than said other vertical wall. Further, the protuberances at each gap typically have upper surfaces which taper downwardly and toward one another.

It is a further object to provide re-entrant side recesses formed in the handle body to intersect said front and rear body sides, said recesses spaced in succession along the length of the body, there being ribs formed between successive of said recesses and located to be normally grasped when the user's hand closes about the handle. In this regard, the handle body typically may formed generally vertical ribs located in longitudinal succession at said front and rear body sides, and between said gaps. Finally, the body may form through openings intersecting said front and rear sides, and proximate said gaps, for reception of a shoulder strap to be carried by the user.

These and other objects and advantages of the invention, as well as the details of an illustrative embodiment, will be more fully understood from the following specification and drawings, in which:

DRAWING DESCRIPTION

DETAILED DESCRIPTION

Figure 6:
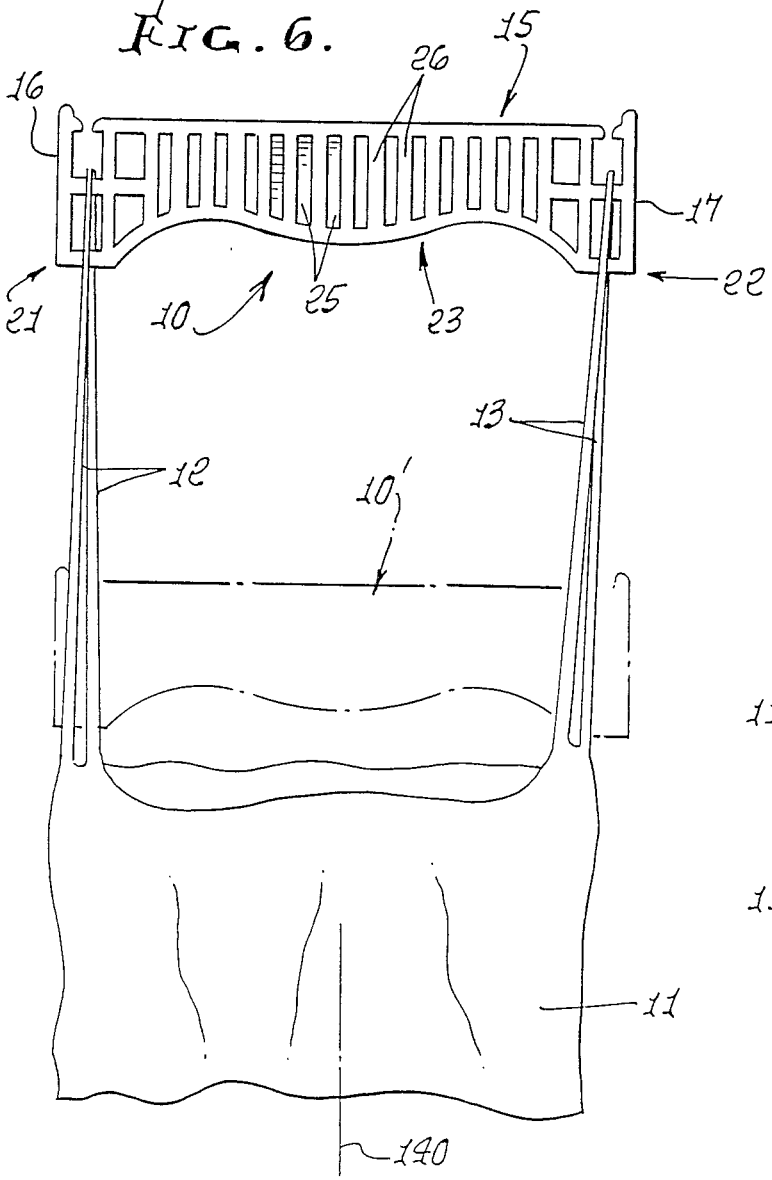
FIG. 6 is an elevation showing a flimsy plastic bag with straps supported by the FIG. 1 handle.

In the drawings, the molded, hard plastic handle 10 is adapted to support a flimsy thin plastic (polyethylene film, for example) grocery type bag 11 as seen in FIG. 6. That bag has loop shaped straps or strands 12 and 13 which are flimsy, yet strong and supported by the handle, as shown.

The handle body 15 is horizontally longitudinally elongated, and has opposite ends 16 and 17, front and rear sides 18 which are alike, and top and bottom surfaces 19 and 20. Also, the body has opposite end portions 21 and 22, and an elongated intermediate portion 23. The handle body top surface 19 is substantially horizontal between end portions 21 and 22, and the bottom surface 20 associated with intermediate portion 23 is downwardly convex at a middle section **20*a*, and downwardly concave at sections 20***b*, between 20*a* and opposite end portions 21 and 22.

The handle body includes re-entrant recesses 25 formed in front and rear sides of the body, and which are vertically elongated and spaced lengthwise along the handle body length. Such recesses intersect that front and rear upright sides of the body so that a series of vertical ribs 26 is formed at each side of the body. Such ribs are easily grasped, normally, to prevent slippage of the user's hand on and particularly lengthwise along the body. The ribs may have convex outermost surfaces as at 26*a*, and those surfaces may be textured in a manner similar to knurling, as at 26*b*, to increase the user's grip. The bottoms of the recesses, seen at 26c extend and define parallel and vertical planes 27 and 28 between which a unitary strut is formed to extend lengthwise of the handle body, and interiorly thereof. The ribs 26, and body top and bottom portions that are free of recesses, provide reinforcing, whereby a sturdy, unbending, lightweight, unitary handle is formed, and is easily moldable. Note larger recesses 30*a*, 30*b* and 30*c* at each of the end portions 21 and 22, and associated ribs 31–33.

Figure 1:
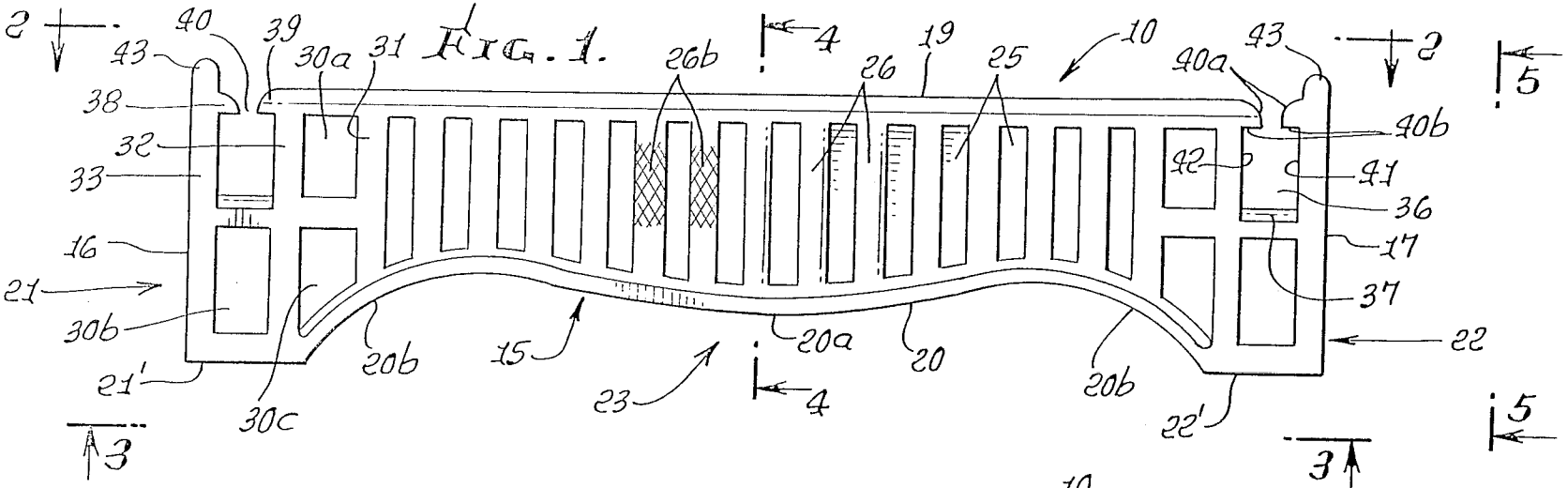
FIG. 1 is a side elevation showing a handle incorporating the invention.
Figure 2:
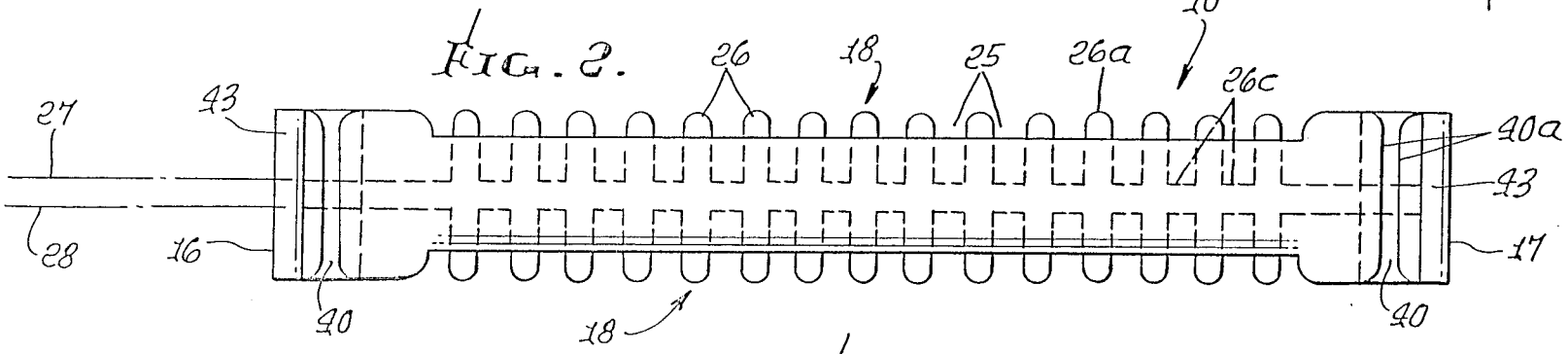
FIG. 2 is a top plan view taken on lines 2—2 of FIG. 1.
Figure 3:
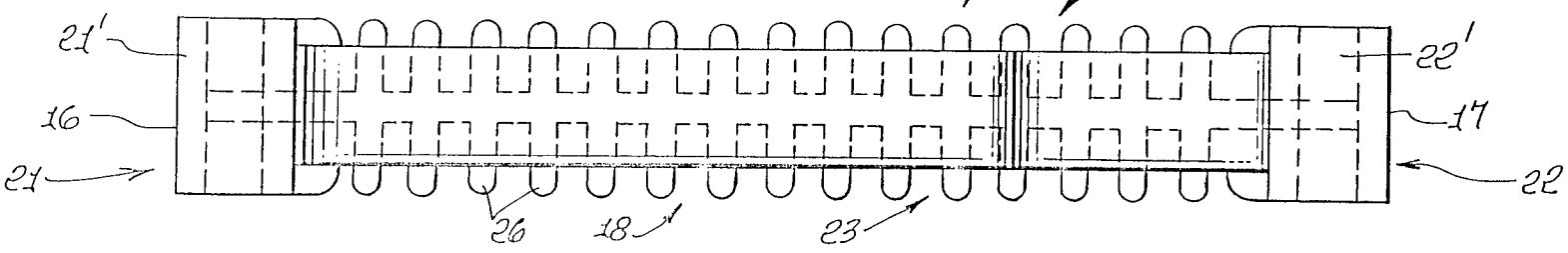
FIG. 3 is a bottom plan view taken on lines 3—3 of FIG. 1.
Figure 4:
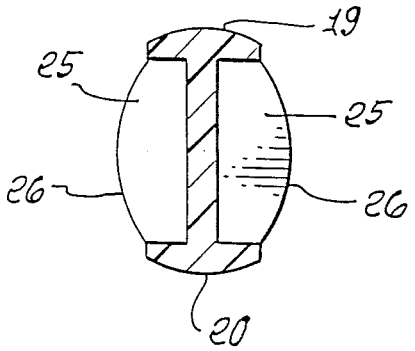
FIG. 4 is a section taken on lines 4—4 of FIG. 1.
Figure 5:
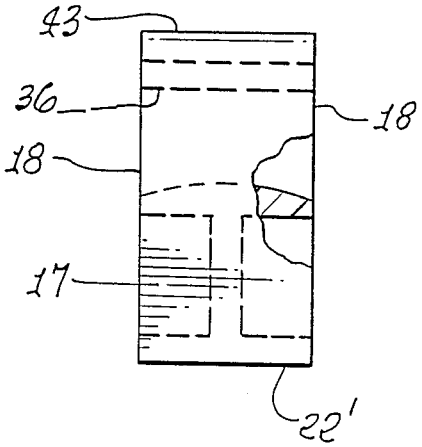
FIG. 5 is an end view taken on lines 5—5 of FIG. 1.

The handle body also includes through slots or recesses 36 extending downwardly at each of the end portions, from the top surface 19, and terminating within each end portion at bag strap support surfaces 37. The latter are upwardly crowned or crested as seen in FIG. 5, and extend between the front and rear sides 18, as do the recesses 36. Top surface 19 is also crowned, widthwise.

The handle body also defines local protuberances 38 and 39 extending in the length direction of the handle, and into the recesses at their uppermost extents. The widths of the recesses are narrowed by the protuberances to form gaps 40 spaced above the lowermost extents of the recesses. Note that the top surfaces 40*a* of the protuberances taper downwardly to ease entry of the bag straps into the recesses below the protuberances; also, the bottom surfaces 40*b* of the protuberances are normal to the recess vertical walls 41 and 42, to prevent movement of the trapped straps 12 toward the gaps and at the recesses. Wall 41 is taller than wall 42, and extends adjacent the upward protuberances 43 that blocks sliding of the straps off an end of the handle, when the straps are above the gap.

The recesses are adapted to receive the straps of more than one bag, whereby the handle can support multiple bags.

Figure 7:
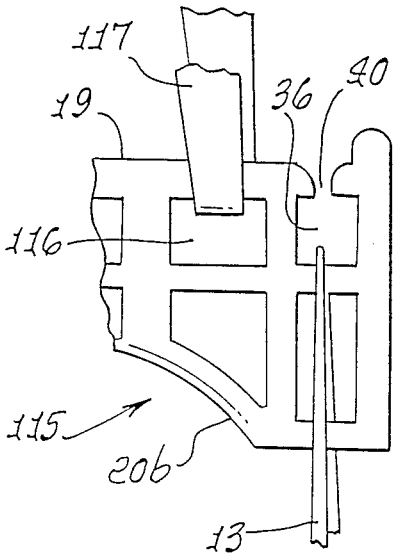
FIG. 7 is a fragmentary side view showing shoulder strap support of modified handle that also has the features of the FIG. 1 handle.

FIG. 7 shows a modified handle body 115 having enlarged openings 116 extending through it, at each end portion, for passing or receiving a shoulder strap 117 to be carried by the user.

Finally, the handle can be traveled along the retained bag straps toward the open upper end of the bag or bags, and then secured close to the open end of the bag, serving to close it, as for example by twisting the handle with its retained straps, about a vertical axis. The protuberances prevent strap release from the recesses, during such handle movement. That handle "down" position is indicated in broken lines 10' in FIG. 6, and the vertical axis of twist appears at 140.

End portions 21 and 22 have flat bottom surfaces at 21' and 22'.

In operation, the handle and bag straps are manipulated to allow the plastic straps to feed over and downwardly along the upper surfaces of the protuberances, and through the gaps, under loading exerted by the bag and articles carried therein, and seating said straps at the bottom of said recesses. Further, the handle may be slid along the bag straps to pass the straps endwise through the two recesses, to thereby displace the handle toward the top of the bag, tending to close the bag. Thereafter, the handle may be twisted to twist the bag straps, tending to further close the bag.

I claim:

1. A one-piece handle for supporting the flimsy plastic strap or straps of a flimsy plastic grocery type bag, comprising:

(a) a handle body which is horizontally, longitudinally elongated and has opposite ends, front and rear sides, and top and bottom surfaces, the body having opposite end portions and an intermediate portion between said end portions, (b) there being recesses extending downwardly at said end portions from said top surfaces and terminating within said end portions, said recesses intersecting said front and rear sides, (c) the handle body defining local protuberances spaced part from one another in the length direction of said handle and extending into the recesses, the widths of the recesses being narrowed by said protuberances to form gaps spaced above the lowermost extents of the recesses.

all of the protuberances extending substantially at the level of the top surface, (d) there being two pairs of said protuberances, the protuberances of a first pair extending longitudinally oppositely and into one said recess, and the protuberances of the second pair extending longitudinally oppositely and into the other said recess, a gap being formed between the protuberances of each pair, the width of each said recess in a longitudinal direction and directly below the protuberances thereabove, being substantially greater than the width of the said gap between the protuberances, (e) each said recess having opposite vertical walls from which the two protuberances project toward one another, the protuberances having undersides normal to said walls and overhanging the recesses, one of said walls of each said recess having a vertical dimension substantially greater than the vertical dimension of the other wall, said one vertical wall located closer to the end of the handle than said other vertical wall, and said one vertical wall projecting above the protuberance projecting therefrom and associated therewith and being above the level of said top surface so as to block the sliding of the straps off an end of the handle when the straps are above the gap, the protuberances at each said gap have upper surfaces which taper downwardly and toward one another.

2. The handle of claim 1 wherein each said recess has a horizontal bottom wall, which is crowned, widthwise.

3. The combination comprising the handle of claim 2, and including said flimsy plastic bag with said strap or straps thereof respectively received into said recesses at the uppermost ends of the strap or straps.

4. The handle of claim 1 wherein said handle body top surface is substantially horizontal, there being additional recess at said end portions, and extending widthwise through the body, below said top surface, for reception of shoulder strap means to be carried by the user.

5. The handle of claim 4 wherein said handle body bottom surface has a downwardly convex middle section, and two downwardly concave sections at opposite ends of said middle section, beneath said additional recesses.

6. The combination comprising the handle of claim 1, and including said flimsy plastic bag with said strap or straps thereof respectively received into said recesses at the uppermost ends of the strap or straps.

7. The handle of claim 1 wherein there are re-entrant side recesses formed in the handle body to intersect said front and rear body sides, said recesses spaced in recession along the length of the body, there being ribs formed between successive of said recesses and located to normally grasped when the user's hand closes about the handle.

8. The handle of claim 1 wherein the handle body forms generally vertical ribs located in longitudinal succession of said front and rear body sides, and between said recesses.

* * * * *